US011350756B1

(12) United States Patent
Walter

(10) Patent No.: US 11,350,756 B1
(45) Date of Patent: Jun. 7, 2022

(54) MODULAR ARMREST SYSTEM

(71) Applicant: CLAM CORPORATION, Rogers, MN (US)

(72) Inventor: Thomas A. Walter, Cologne, MN (US)

(73) Assignee: CLAM CORPORATION, Rogers, MN (US)

( * ) Notice: Subject to any disclaimer, the term of this patent is extended or adjusted under 35 U.S.C. 154(b) by 0 days.

(21) Appl. No.: 16/953,943

(22) Filed: Nov. 20, 2020

(51) Int. Cl.
*A47C 7/54* (2006.01)
*A47C 7/62* (2006.01)
*A47C 3/18* (2006.01)

(52) U.S. Cl.
CPC ..... *A47C 7/546* (2013.01); *A47C 3/18* (2013.01); *A47C 7/624* (2018.08)

(58) Field of Classification Search
CPC ..... A47C 7/541; A47C 7/546; A47C 7/624; A47C 3/18
See application file for complete search history.

(56) References Cited

U.S. PATENT DOCUMENTS 2,602,488 A 7/1952 Conning
2,650,650 A 9/1953 Brown
2,841,207 A * 7/1958 Sweeney ..... B63B 29/06 297/252
4,870,984 A 10/1989 Roth
5,009,467 A 4/1991 McCoy
5,133,378 A 7/1992 Tanasychuk
5,143,422 A * 9/1992 Althofer ..... A47C 7/541 297/411.36
5,407,249 A * 4/1995 Bonutti ..... A47C 16/00 297/411.35
5,460,427 A 10/1995 Serber
5,823,624 A 10/1998 Dahlbacka
5,979,988 A 11/1999 Heidmann et al.
6,164,725 A 12/2000 Santa Cruz et al.
6,296,002 B1 10/2001 Tashchyan
6,397,870 B1 6/2002 Madedonsky et al.
6,619,747 B2 9/2003 Ko et al.
6,773,071 B1 * 8/2004 Stasney ..... A47C 7/546 248/118.3
6,962,221 B1 11/2005 Carrette
7,150,442 B2 12/2006 Kleckner
7,213,880 B2 5/2007 Schmitz et al.
7,284,762 B2 10/2007 Mehtonen
7,427,101 B1 9/2008 Zemov
(Continued)

*Primary Examiner* — Philip F Gabler
(74) *Attorney, Agent, or Firm* — Cook Alex Ltd.

(57) ABSTRACT

A modular armrest system for mounting to a seat having a seat bottom with a lower surface and opposed first and second lateral sides. The system includes an elongated base plate that extends below the lower surface of the seat bottom and having at least one aperture that receives at least one fastener adapted to connect the elongated base plate to the seat bottom, and having opposed first and second ends proximate the respective opposed lateral sides. A first armrest assembly has a first mounting bracket having a horizontal portion connected to the first end of the elongated base plate and an upward extending portion connected to a generally horizontal arm support, and a second armrest assembly has a second mounting bracket having a horizontal portion connected to the second end of the elongated base plate and an upward extending portion connected to a generally horizontal arm support.

18 Claims, 10 Drawing Sheets

(56) References Cited

U.S. PATENT DOCUMENTS

| | | | | |
|---|---|---|---|---|
| 8,104,838 | B2 * | 1/2012 | Tsai | A47C 1/0307 297/411.37 |
| 8,181,743 | B2 * | 5/2012 | duCellier | A01M 31/02 182/187 |
| 8,967,723 | B2 | 3/2015 | Boren | |
| 9,296,407 | B1 | 3/2016 | Stucky | |
| 9,394,718 | B1 | 7/2016 | Hill | |
| 10,058,181 | B2 | 8/2018 | Makos | |
| 10,612,265 | B1 | 4/2020 | Walter | |
| 10,722,034 | B2 | 7/2020 | Winterhalter et al. | |
| 2006/0238005 | A1 * | 10/2006 | Walter | B62B 13/06 297/218.2 |

* cited by examiner

MODULAR ARMREST SYSTEM

BACKGROUND OF THE INVENTION

Field of the Invention

The present invention generally relates to armrests for seats, such as may be used to support the arms of a seated person, and more particularly to devices that provide a modular armrest system for mounting to a seat.

Discussion of the Prior Art

There are a variety of devices used for seating of individuals, such as may be advantageous when standing is not required. Certain situations lend themselves to being seated, such as for example when ice fishing. However, there are many seating devices, such as seats mounted to a sled of a flip-over portable shelter, which heretofore have not had armrests. Unfortunately, being seated for extended periods of time with one's arms generally extending forward without support can result in discomfort, such as in the shoulders and neck. The lack of such arm support also can present some difficultly when attempting to use one's arms and hands to brace oneself and push upward from a seated position to a standing position. Having to push against a seat bottom that is below the person can be quite awkward relative to the movement needed to rise to a standing position.

SUMMARY OF THE INVENTION

The purpose and advantages of the invention will be set forth in and apparent from the description and drawings that follow, as well as will be learned by practice of the claimed subject matter.

This disclosure generally provides a modular armrest system for mounting to a seat for which it is advantageous to be able to support the arms of a seated person and to provide improved support for the person to utilize when attempting to rise to a standing position. As a further advantage, the modular armrest system may be adjustable, such as laterally and vertically with respect to the seat for enhanced comfort and convenience. The modular armrest system also has a construction that makes it ideal for being retrofitted or added to an existing seat or included within an original equipment seat assembly.

While the disclosure illustrates the invention in the context of an example modular armrest system connected to a seat on a flip-over portable shelter of the type that may be used, for example, for ice fishing, it will be appreciated that the modular armrest system may be adapted for use with various seats, having other structures and for use for other purposes.

In a first aspect, the present disclosure provides a modular armrest system for mounting to a seat having a seat bottom with a lower surface and opposed first and second lateral sides. The modular armrest system includes an elongated base plate that extends below the lower surface of the seat bottom and further includes at least one aperture that receives at least one fastener adapted to connect the elongated base plate to the seat bottom. The elongated base plate has opposed first and second ends that extend to locations proximate the respective opposed lateral sides of the seat bottom. The system further includes a first armrest assembly and a second armrest assembly, with the first armrest assembly comprising a first mounting bracket having a horizontal portion and an upward extending portion, and the second armrest assembly comprising a second mounting bracket having a horizontal portion and an upward extending portion. The horizontal portion of the first mounting bracket is connected to the first end of the elongated base plate and the horizontal portion of the second mounting bracket is connected to the second end of the elongated base plate, and a first generally horizontal arm support is connected to the upward extending portion of the first mounting bracket and a second generally horizontal arm support is connected to the upward extending portion of the second mounting bracket.

In another aspect, the present disclosure provides the modular armrest system of the first aspect in combination with a seat having a seat bottom with a lower surface, opposed first and second lateral sides, mounting holes for connection to a seat base and the elongated base plate of the modular armrest system includes apertures that receive fasteners that connect the seat base to the seat bottom. The modular armrest system in combination with a seat further includes a seat back pivotally connected to the seat bottom, and the seat back pivots to a folded position located between the first and second armrest assemblies. The modular armrest system in combination with a seat also may further have the seat base include a swivel assembly.

In a still further aspect, the present disclosure provides a modular armrest system of the first aspect further including an accessory mounting base connected to at least one of the first and second armrest assemblies. The system may also include a cupholder, bag or rod holder accessory having a mounting connector removably connected to the accessory mounting base.

It is to be understood that both the foregoing general description and the following detailed description are exemplary, provided for purposes of explanation only and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1:
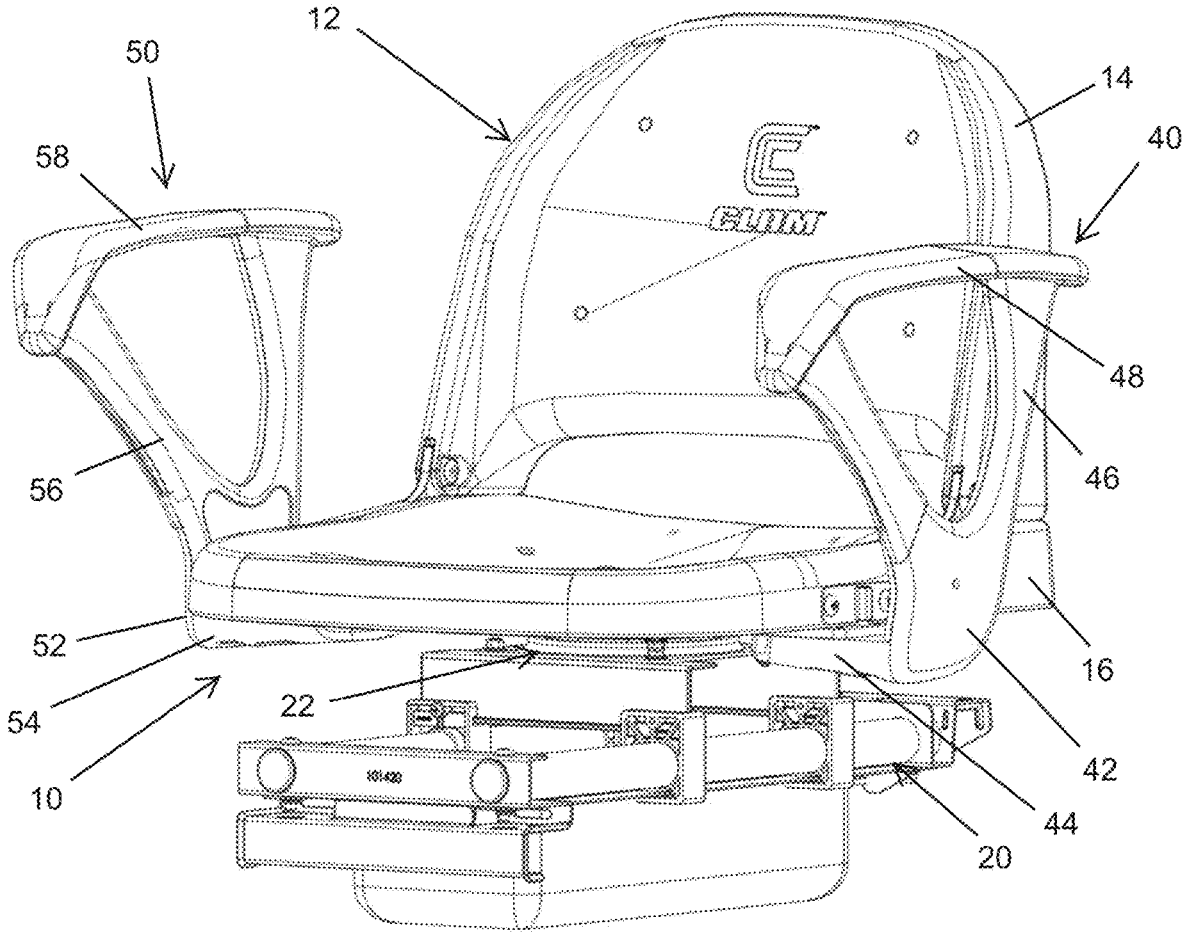
FIG. 1 is a front upper perspective view of an example modular armrest system connected to a seat having a pivotal seat back and being connected to a base that includes a swivel assembly.
Figure 2:
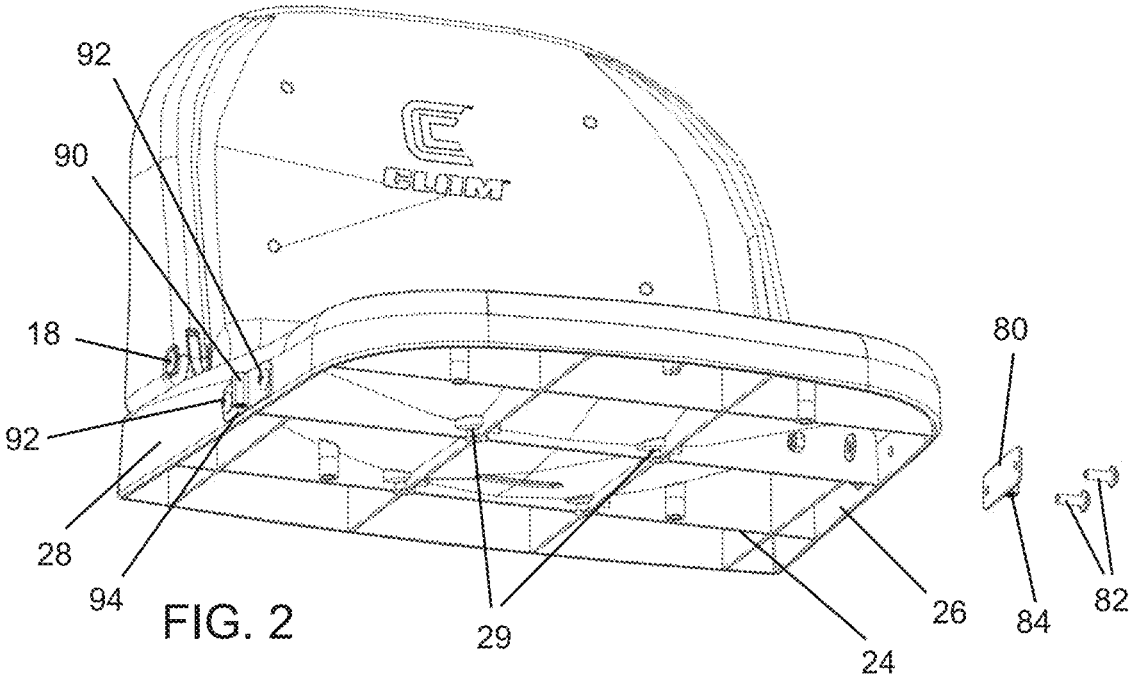
FIGS. 2-4 are a series of front lower partially exploded perspective views of the example modular armrest system connected to the seat shown in FIG. 1 in progressive states of assembly of the system to the seat bottom.
Figure 3:
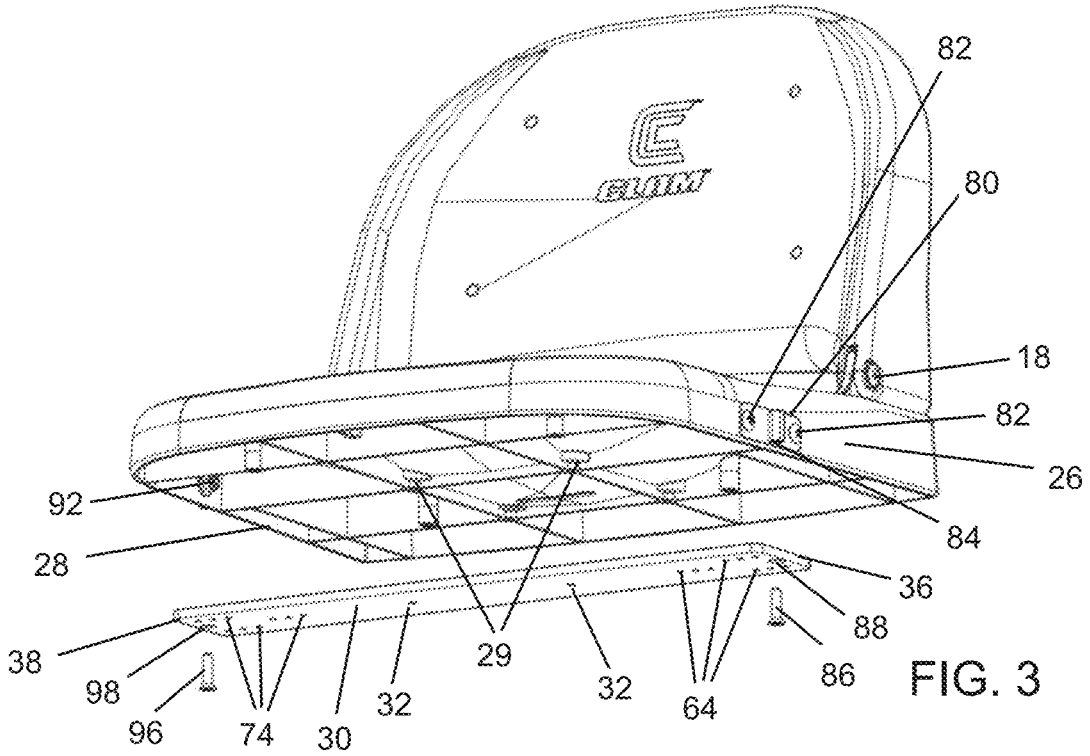

It should be understood that the figures are not to scale. While some mechanical details of example modular armrest systems and seat assemblies, including additional plan and section views of the example shown and of examples that may have alternative configurations have not been included, such details are considered well within the comprehension of those of skill in the art in light of the present disclosure. It also should be understood that the present invention is not limited to the example embodiments illustrated.

DETAILED DESCRIPTION OF THE PREFERRED EMBODIMENT

For the following defined terms, these definitions shall be applied, unless a different definition is given in the claims or elsewhere in this disclosure. As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

Referring generally to FIGS. 1-18, it will be appreciated that modular armrest systems of the present disclosure generally may be embodied within numerous configurations, and may be used on various seats, such as for example, a seat for a portable shelter in the form of a flip-over ice shelter used for ice fishing. Indeed, while acknowledging that all of the example configurations of modular armrest systems need not be shown herein, examples are provided to better demonstrate aspects of the invention and that a variety of configurations and methods of use are contemplated.

FIGS. 1-5 show an example modular armrest system 10 in various states of assembly and connection to a seat 12. The seat 12 has a seat back 14 pivotally connected to a seat bottom 16 at pivots 18. The seat bottom 16 is connected to a base 20 that includes a swivel assembly 22. The modular armrest system 10 is configured for mounting to the seat 12 at the seat bottom 16. The seat bottom 16 has a lower surface 24 and respective opposed first lateral side 26 and second lateral side 28. The modular armrest system 10 includes an elongated base plate 30 that extends below the lower surface 24 of the seat bottom 16. The elongated base plate 30 includes at least one aperture 32 that receives at least one fastener 34 adapted to connect the elongated base plate 30 to the seat bottom 16, such as by receiving the fastener 34 in an aperture in the lower surface 24 of the seat bottom 16. The elongated base plate 30 also includes respective opposed first end 36 and second end 38. The respective opposed first and second ends 36, 38 extend to locations proximate the respective opposed first and second lateral sides 26, 28 of the seat bottom 16. In this example, the at least one aperture 32 in the elongated base plate 30 that receives at least one fastener 34 adapted to connect the elongated base plate 30 to the seat bottom 16 further includes a plurality of generally centrally located apertures 32 adapted to receive a respective plurality of fasteners 34 adapted to connect the elongated base plate 30 to the seat bottom 16.

Figure 5:
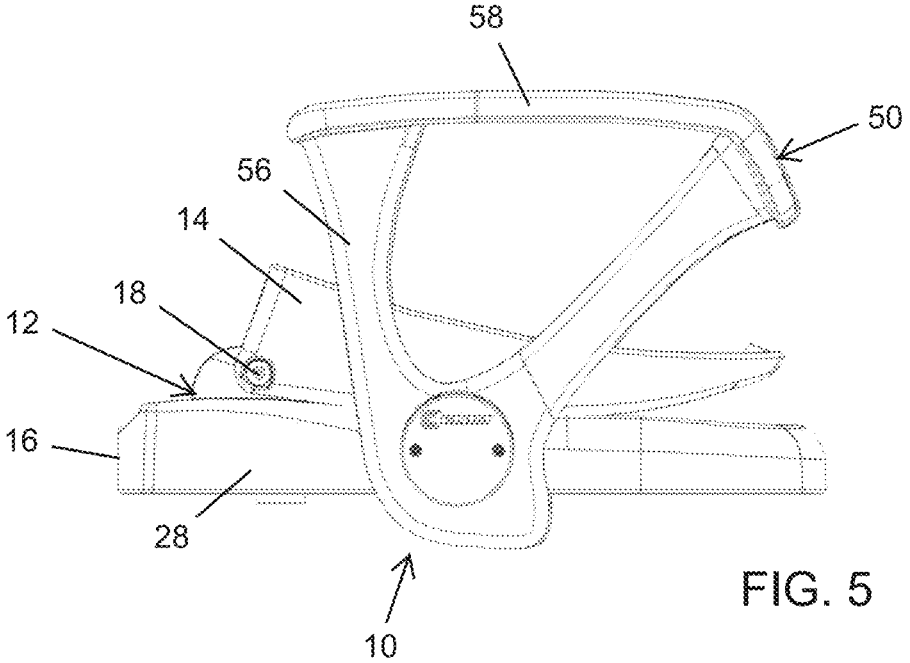
FIG. 5 is a side view of the example modular armrest system connected to the seat shown in FIGS. 1-4, with the seat back pivoted to a folded position located between the first and second armrest assemblies.

A first armrest assembly 40 includes a first mounting bracket 42 having a horizontal portion 44 and an upward extending portion 46. A second armrest assembly 50 includes a second mounting bracket 52 having a horizontal portion 54 and an upward extending portion 56. The horizontal portion 44 of the first mounting bracket 42 is connected to the first end 36 of the elongated base plate 30 and the horizontal portion 54 of the second mounting bracket 52 is connected to the second end 38 of the elongated base plate 30. A first generally horizontal arm support 48 is connected to the upward extending portion 46 of the first mounting bracket 42 and a second generally horizontal arm support 58 is connected to the upward extending portion 56 of the second mounting bracket 52. As shown in FIG. 5, the seat back 16 pivots to a folded position located between the first and second armrest assemblies 40, 50.

Figure 4:
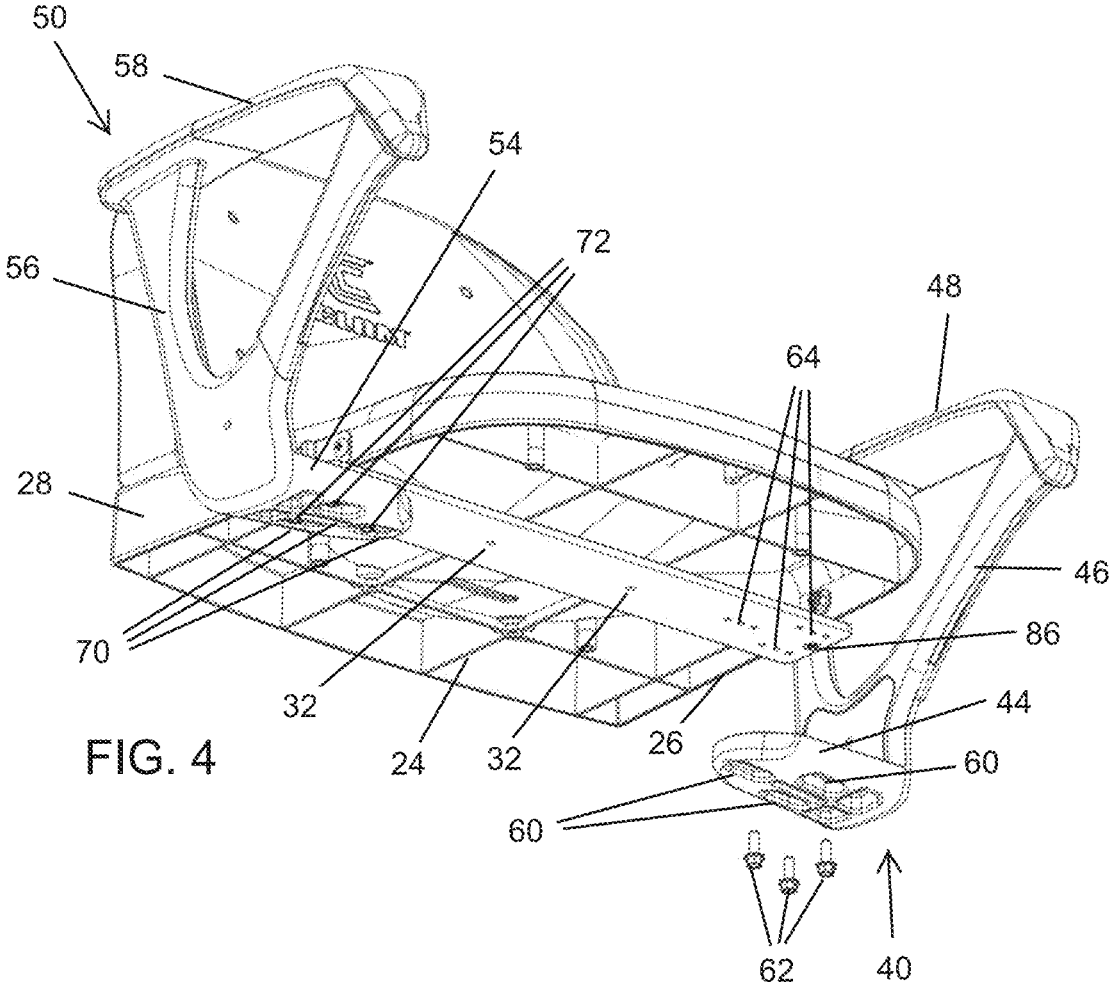
Figure 8:
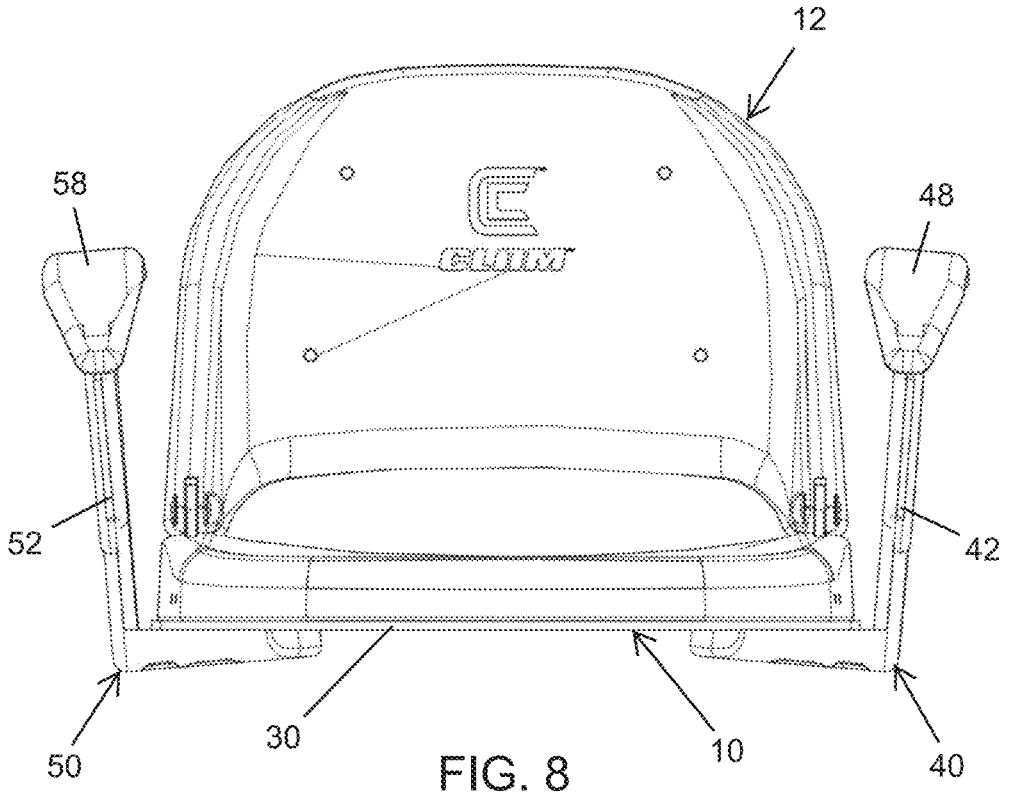
FIGS. 8 and 9 are front views of the example modular armrest system in combination with the seat shown in FIGS. 1-7, with the armrest assemblies in a respective narrow-most first laterally adjusted position in FIG. 8 and in a wider second laterally adjusted position in FIG. 9.
Figure 9:
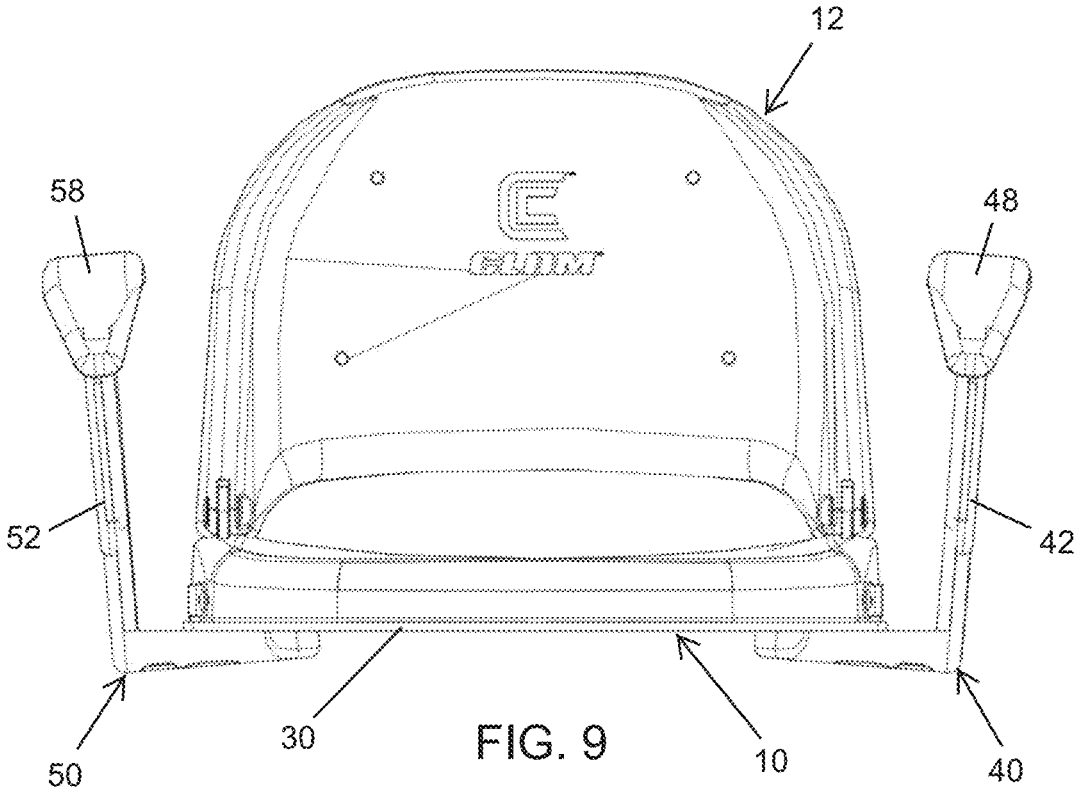

As will be appreciated from FIGS. 4, 8 and 9, the first and second armrest assemblies 40, 50 of the modular armrest system 10 may be adjustable relative to the elongated base plate 30. In these figures, the first and second armrest assemblies 40, 50 are laterally adjustable relative to the elongated base plate 30, from a narrow-most first laterally adjusted position in FIG. 8 to a wider second laterally adjusted position in FIG. 9. It will be appreciated that there may be two or more lateral positions.

The lateral adjustability in this example is achieved by having the horizontal portion 44 of the first mounting bracket 42 and the horizontal portion 54 of the second mounting bracket 52 be laterally adjustable relative to the respective first and second ends 36, 38 of the elongated base plate 30. More particularly, in the present example, the horizontal portion 44 of the first mounting bracket 42 includes at least one aperture 60 that receives at least one fastener 62 that is connected to at least one aperture 64 proximate the first end 36 of the elongated base plate 30. Similarly, the horizontal portion 54 of the second mounting bracket 52 includes at least one aperture 70 that receives at least one fastener 72 that is connected to at least one aperture 74 proximate the second end 38 of the elongated base plate 30.

It will be appreciated that in the example shown, the at least one aperture 64 proximate the first end 36 of the elongated base plate 30 is a threaded aperture and the at least one aperture 74 proximate the second end 38 of the elongated base plate 30 is a threaded aperture. As such, the corresponding at least one first fastener 62 may be a threaded screw that engages the respective at least one aperture 64 and the corresponding at least one second fastener 72 may be a threaded screw that engages the respective at least one aperture 74. However, it will be appreciated that other fastening structures and configurations may be utilized.

In addition, the lateral adjustability of the modular armrest system 10 is provided in this example by the at least one aperture 60 in the horizontal portion 44 of the first mounting bracket 42 being configured as an elongated slot, and by the at least one aperture 70 in the horizontal portion 54 of the second mounting bracket 52 being configured as an elongated slot. Thus, the respective elongated slots 60, 70 permit lateral adjustment of the respective first and second armrest assemblies 40, 50 relative to the seat bottom 16. Lateral adjustment also may be achieved by having a plurality of apertures 64, 74 in the elongated base plate 30, which permit the fasteners 62, 72 to be repositioned laterally along the elongated base plate 30. Thus, various combinations and shapes of apertures may be utilized to achieve lateral adjustment. For example, as shown, in the present example modular armrest system 10, the at least one aperture 60 in the horizontal portion 44 of the first mounting bracket 42 may include a plurality of apertures 60 and they may be slots, while the at least one aperture 70 in the horizontal portion 54 of the second mounting bracket 52 may include a plurality of apertures 70 and they similarly may be slots. Moreover, in the present example, the at least one aperture 64 proximate the first end 36 of the elongated base plate 30 includes a plurality of apertures 64 and the at least one aperture 74 proximate the second end 38 of the elongated base plate 30 includes a plurality of apertures 74. The plurality of apertures 64, 74 may be configured to permit connection by a plurality of fasteners 62, 72, and to permit lateral adjustment, there may be a plurality of laterally spaced apertures 64, 74 configured to receive each fastener 62,72.

To enhance rigidity of the modular armrest system 10, there may be additional connections between the components of the system and/or between the system and the seat to which it is connected. For instance, the modular armrest system 10 of the present example further includes a first mounting plate 80 adjacent and connected to the first lateral side 26 of the seat bottom 16 and is connected to the first end 36 of the elongated base plate 30. Similarly, a second mounting plate 90 is adjacent and connected to the second lateral side 28 of the seat bottom 16 and is connected to the second end 38 of the elongated base plate 30.

The first mounting plate 80 may be connected to the seat bottom 16, such as by fasteners. The first mounting plate 80 includes at least one horizontal aperture that receives a fastener 82 adapted to connect to the first lateral side 26 of the seat bottom 16, and the second mounting plate 90 includes at least one horizontal aperture that receives a fastener 92 adapted to connect to the second lateral side 28 of the seat bottom 16. The at least one horizontal aperture in the first mounting plate 80 may include a plurality of horizontal apertures that receive a plurality of fasteners 82 adapted to connect to the first lateral side 26 of the seat bottom 16, and the at least one horizontal aperture in the second mounting plate 90 may include a plurality of horizontal apertures that receive a plurality of fasteners 92 adapted to connect to the second lateral side 28 of the seat bottom 16. The first mounting plate 80 also includes a vertical aperture 84 that receives a fastener 86 connected to an aperture 88 proximate the first end 36 of the elongated base plate 30. Similarly, the second mounting plate 90 includes a vertical aperture 94 that receives a fastener 96 connected to an aperture 98 proximate the second end 38 of the elongated base plate 30.

With respect to mounting to the seat base 20, in the present example the elongated base plate 30 extends laterally below the seat bottom 16 and is captured between the seat base 20 and the seat bottom 16. The example shown includes a swivel assembly 22 having an upper plate rotatably connected to a lower plate. Fasteners 34 extend through forward apertures in the upper plate and connect the upper plate of the swivel assembly 22 to the elongated base plate 30 and the seat bottom 16. To account for the thickness of the elongated base plate 30 when utilizing the modular armrest system 10, the system 10 of this example further includes spacers 100 adapted to be locate adjacent to the lower surface 24 if the seat bottom 16. The spacers 100 are captured by fasteners 102 that extend through rearward apertures in the upper base plate of the swivel assembly 22 and connect the upper base plate to the seat bottom 16. Thus, the modular armrest system 10 may be used in combination with a seat 12 having a seat bottom 16 having a lower surface 24, opposed first and second lateral sides 26, 28 and mounting holes 29 for connection to a seat base 20. As noted, the elongated base plate 30 of the modular armrest system 10 includes apertures 32 that receive fasteners 34 that connect the seat base 20 to the seat bottom 16.

Figure 6:
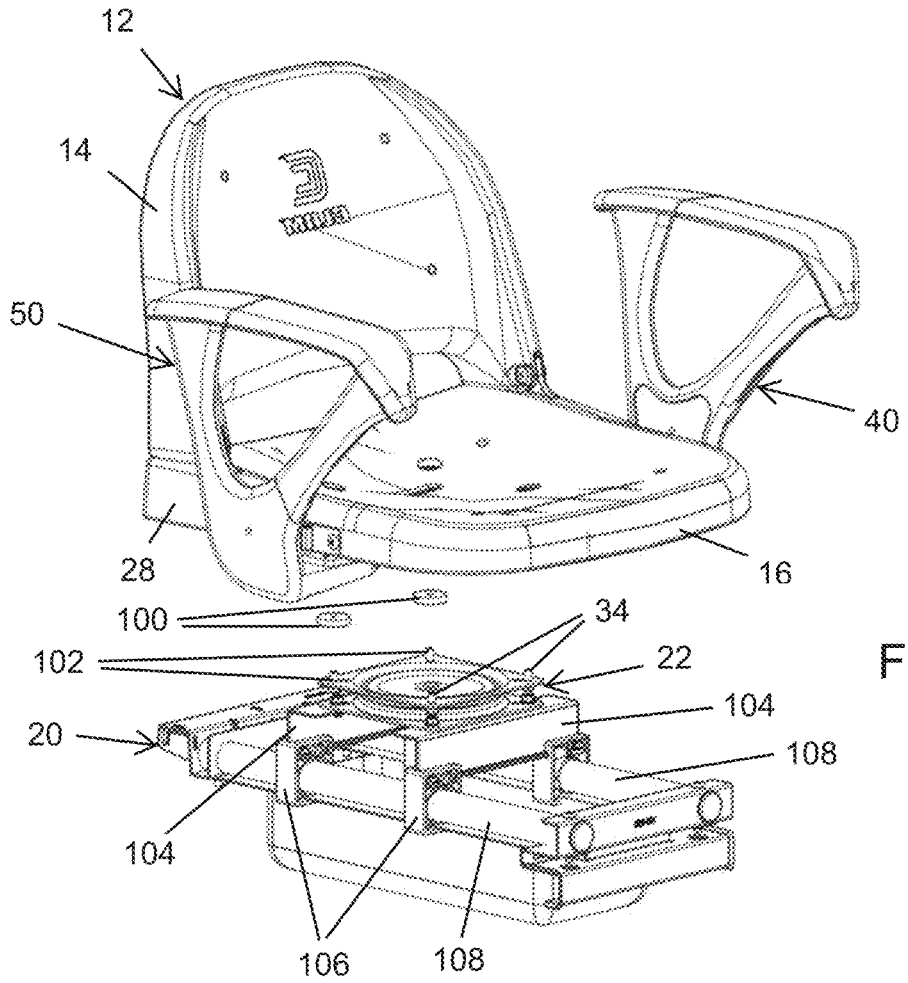
FIG. 6 is a front upper partially exploded perspective view of the modular armrest system in combination with the example seat shown in FIGS. 1-5, with the seat located above a seat base having a swivel assembly.
Figure 7:
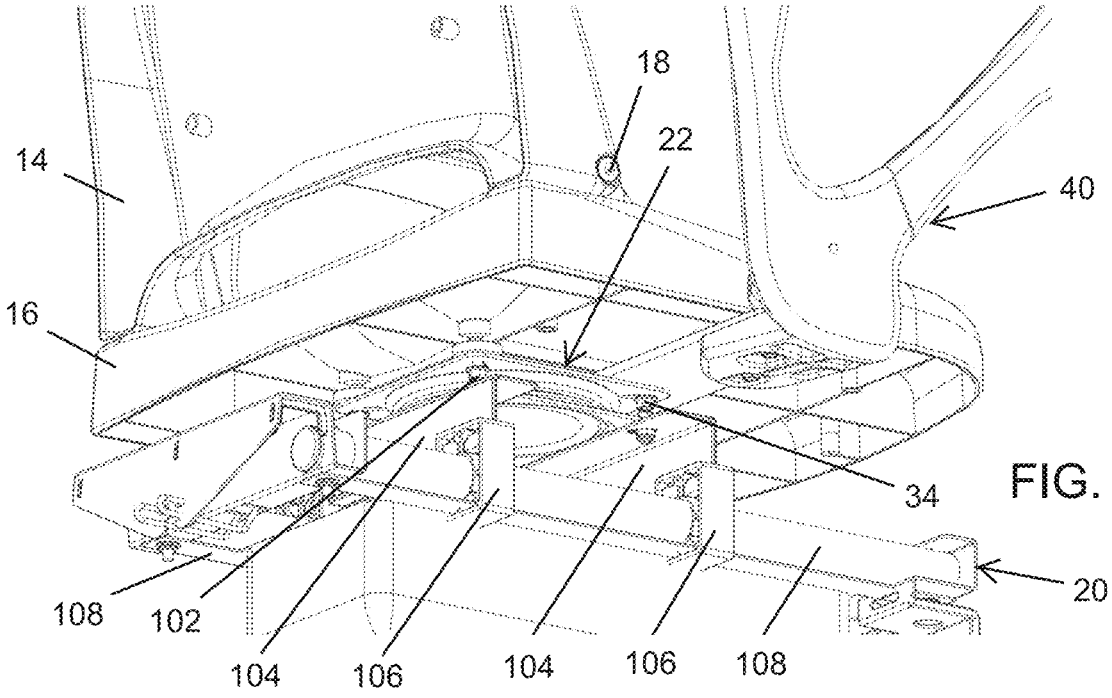
FIG. 7 is a rear lower assembled perspective view of the components shown in FIG. 6.

It will be appreciated that the modular armrest system 10 may be connected to a variety of seats and seat bases. In the present example, in addition to the seat base 20 having a swivel assembly 22, the seat base 20 additionally permits fore and aft adjustment by means of brackets 104 and slides 106 that are adjustable along parallel rails 108, as seen in FIGS. 6 and 7.

Figure 10:
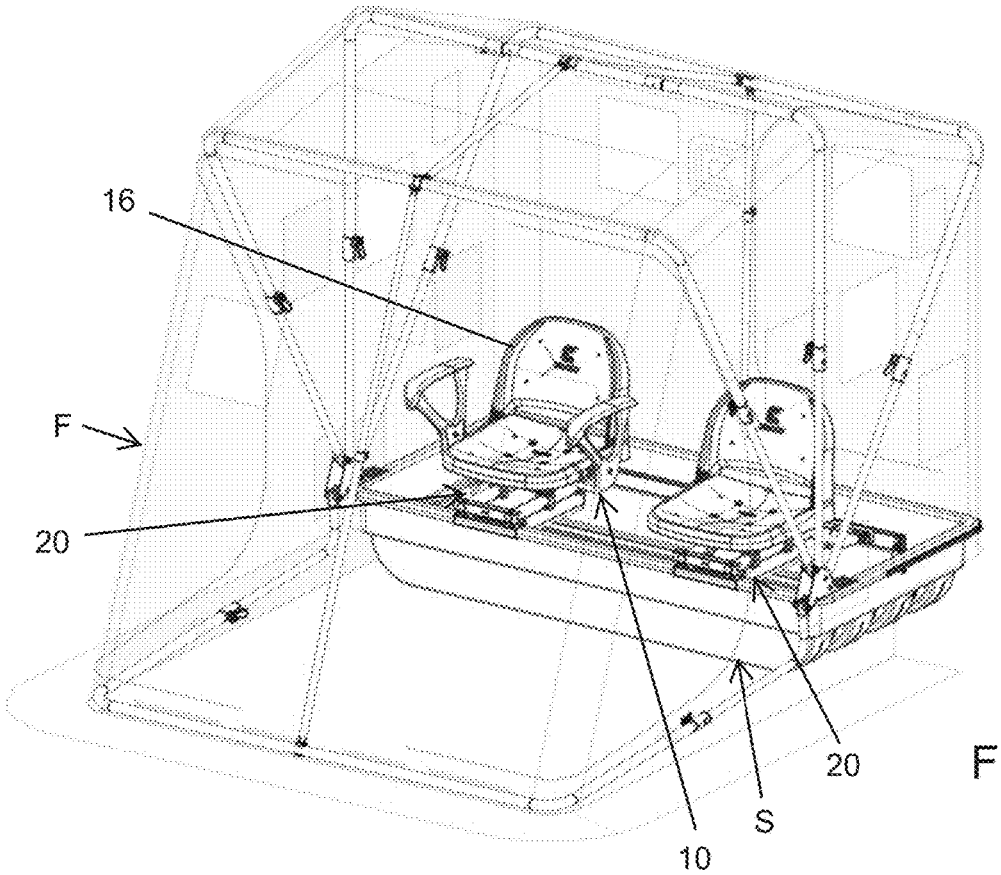
FIG. 10 is a front upper perspective view of an example flip-over portable shelter having one seat without armrests and one seat including a modular armrest system in accordance with the example of FIGS. 1-9.
Figure 11:
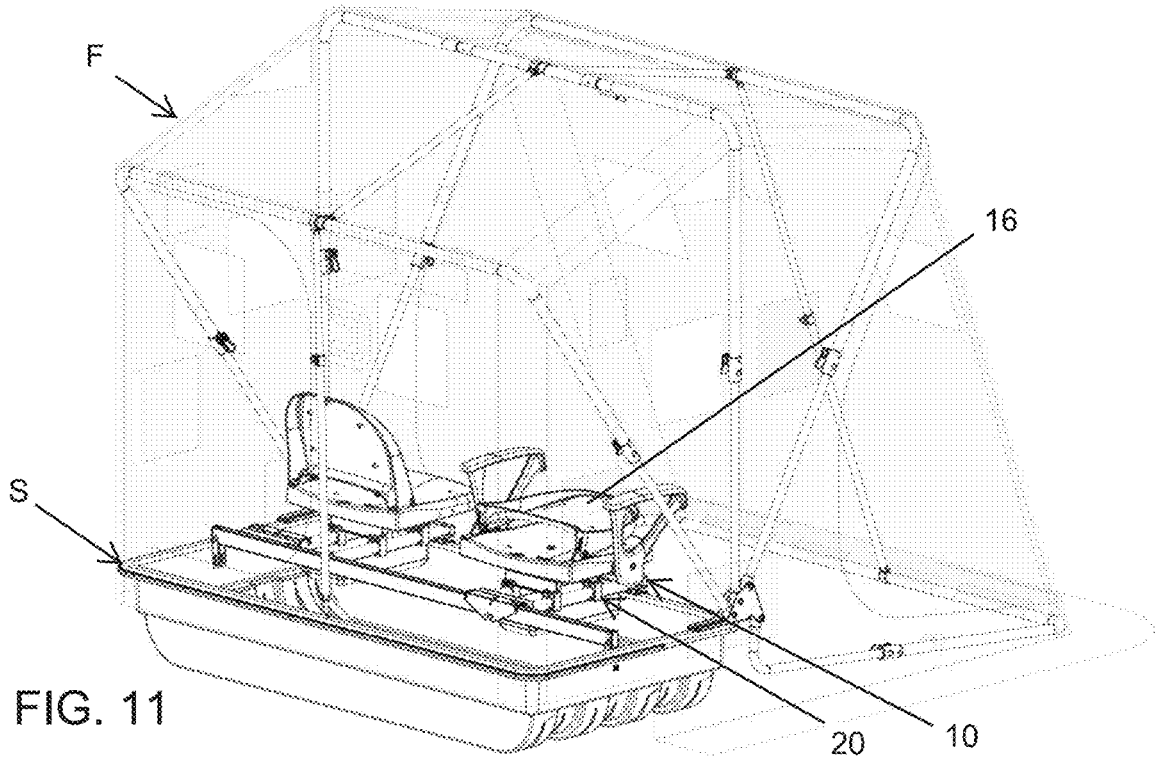
FIG. 11 is a rear upper perspective view of the example in FIG. 10, with the seat back of the seat having the modular armrest system being pivoted to a folded position located between the first and second armrest assemblies.

As previously noted, in addition to other environments, the seats to which the modular armrest system 10 may be connected may include seats within portable shelters, such as the flip-over shelter F, shown in FIGS. 10 and 11. The flip-over shelter includes a sled S to which seat bases 20 are connected. The example shows left seat having a standard configuration that lacks armrests. In contrast, a modular armrest system 10 is connected to the right seat. In FIG. 10, the seat back 16 is in an upright position. In FIG. 11, the pivotal seat back 16 is pivoted to a folded position located between the first and second armrest assemblies. As such, the modular armrest system 10 still permits adequate folding of the seat for collapsing of the shelter for convenient transportation and storage.

Figure 18:
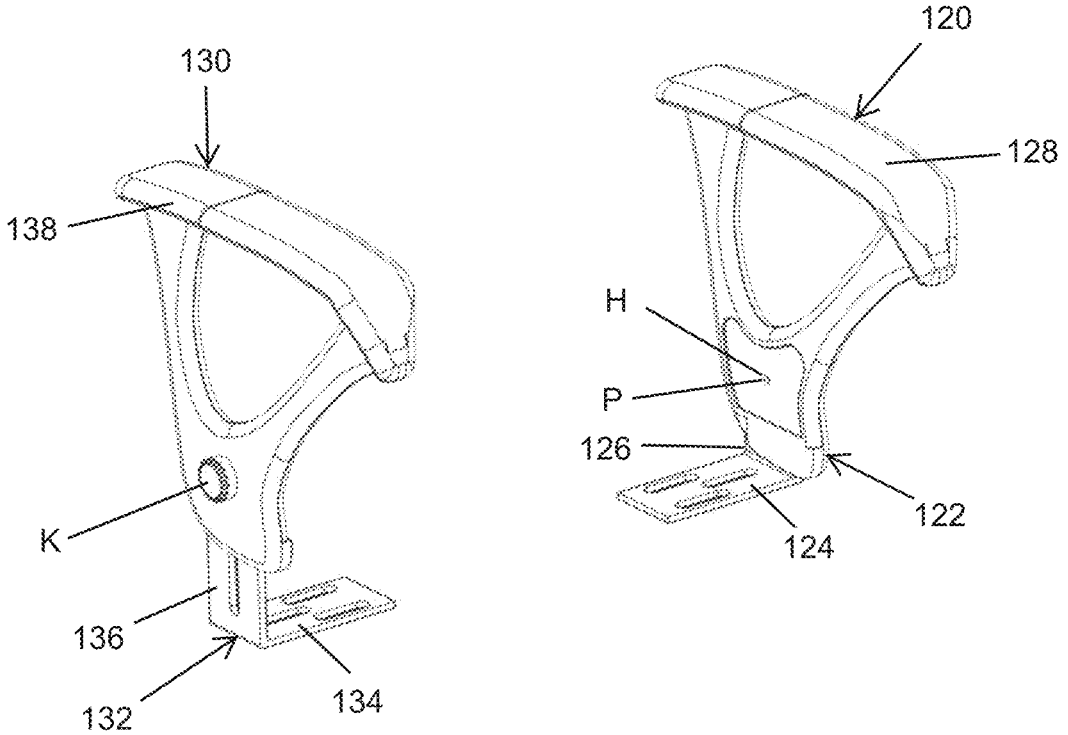
FIG. 18 is a front upper perspective view of alternative example first and second armrest assemblies, which are adjustable laterally relative to a seat and the elongated base plate, as well as vertically.

While lateral adjustability of the modular armrest system 10 has been discussed above, it will be appreciated that the armrest assemblies also may provide for other adjustment, such as fore and aft, or vertical adjustment. Indeed, alternative armrest assemblies are shown in FIG. 18, wherein first and second armrest assemblies are vertically adjustable relative to the elongated base plate to which they would be connected.

A first armrest assembly 120 includes a first mounting bracket 122 having a horizontal portion 124 and an upward extending portion 126. A first generally horizontal arm support 128 is vertically adjustable relative to the first mounting bracket 122. A second armrest assembly 130 includes a second mounting bracket 132 having a horizontal portion 134 and an upward extending portion 136. A second generally horizontal arm support 138 is vertically adjustable relative to the second mounting bracket 132. In particular, the first generally horizontal arm support 128 of this alternative embodiment is vertically slidable relative to the upward extending portion 126 of the first mounting bracket 122 and the second generally horizontal arm support 138 is vertically slidable relative to the upward extending portion 136 of the second mounting bracket 132.

Each armrest assembly 120, 130 includes a knob K with a threaded post P that engages a threaded hole H, which facilitates selective clamping of the slidably adjustable generally horizontal arm support 128, 138 to the upward extending portion 126, 136. A range of adjustment is depicted in FIG. 18 where a first lower-most position is shown for the first armrest assembly 120, while a second higher-most position is shown for the second armrest assembly 130.

Figure 12:
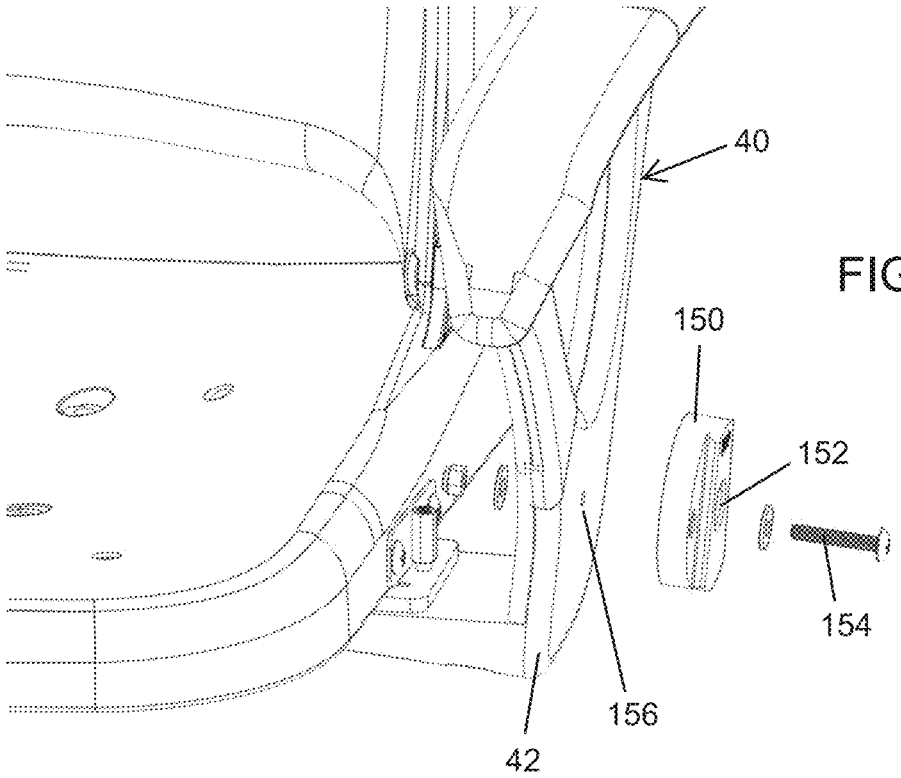
FIG. 12 is a front upper partially exploded perspective view showing an armrest assembly of the example shown in FIGS. 1-11 and further including an accessory mounting base to be connected to the armrest assembly.

The modular armrest system 10 further facilitates convenient mounting of accessories for use by a seated individual. As shown in FIG. 12, an accessory mounting base 150 is connected to at least one of the first and second armrest assemblies 40, 50. The accessory mounting base 150 of this example is of disc shape and includes an aperture 152 that receives a fastener 154 that extends through an aperture 156 in the a first armrest bracket 42. The fastener 154 is shown as a screw and nut that removably secure the accessory mounting base 150 to the first armrest bracket 42. The accessory mounting base 150 is shown in FIGS. 12-17, and removably receives any accessory that is connected to a mounting connector 160 having a complementary configuration for slidable engagement. Thus, these examples show one configuration for removable accessory mounting wherein the accessory mounting base 150 includes a raised wedge-shape, while the mounting connectors 160 include a complementary recess or channel that slidably engages the accessory mounting base 150.

Figure 13:
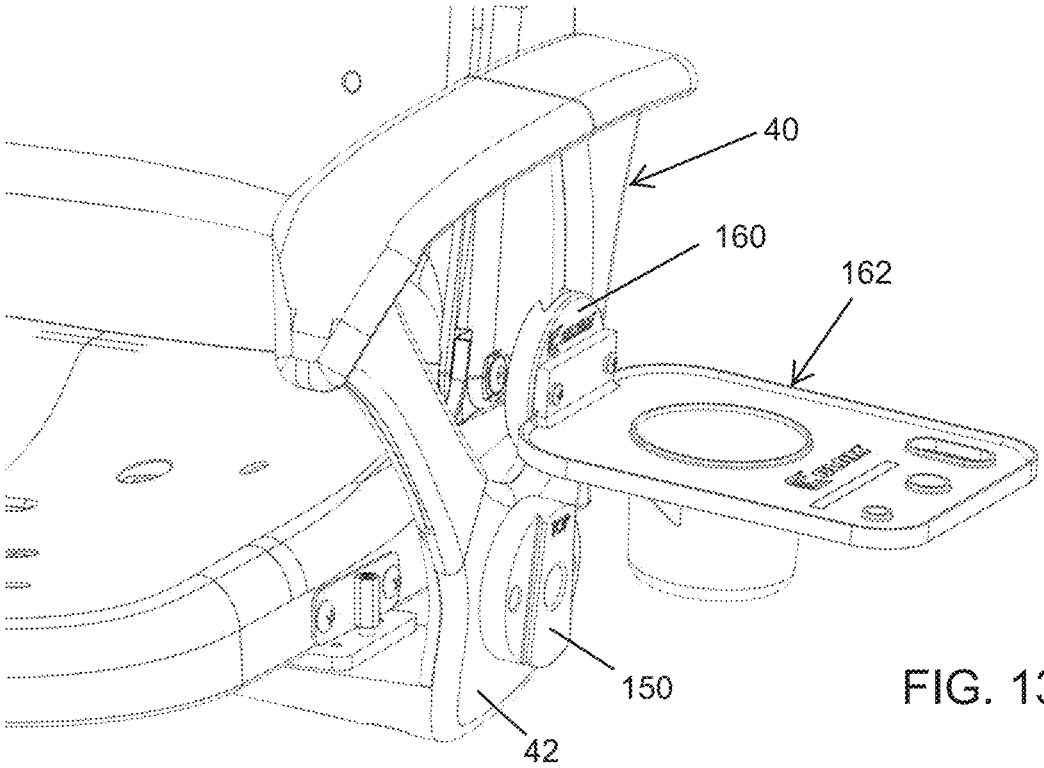
FIG. 13 is a front upper partially exploded perspective view showing the example armrest assembly of the modular armrest system shown in FIG. 12 and further including a cupholder accessory having a connector that is complementary to the accessory mounting base and being positioned for removable connection to the mounting base on the armrest assembly.
Figure 14:
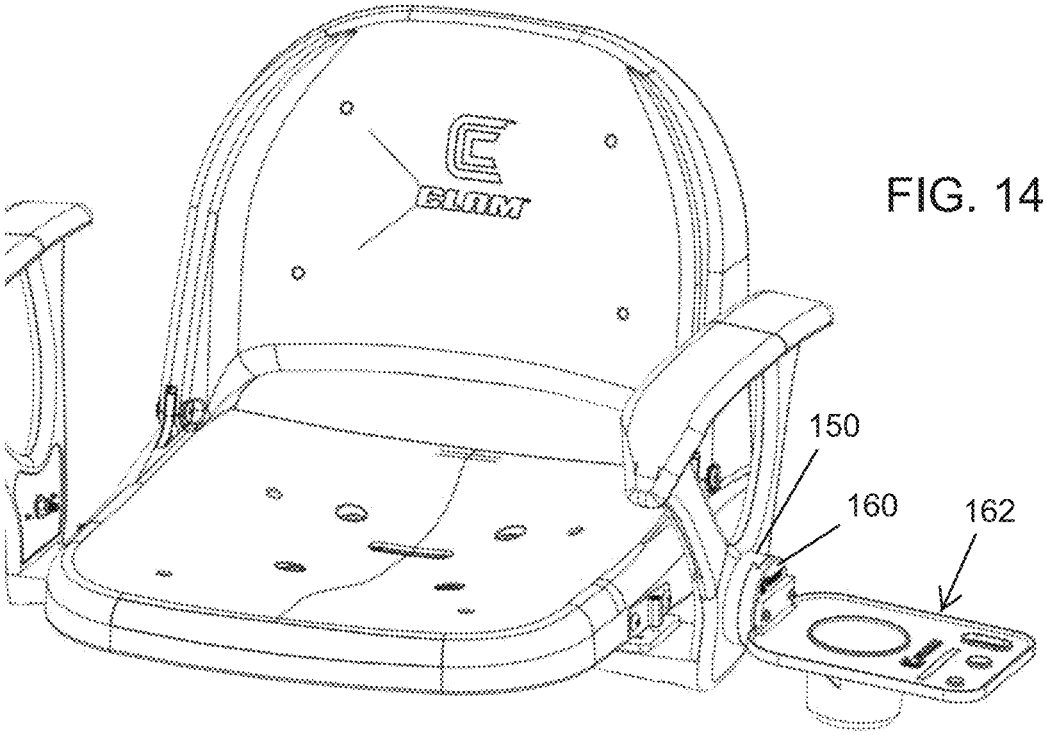
FIG. 14 is a front upper perspective view showing the example in FIG. 13, with the connector of the cupholder accessory removably connected to the mounting base on the armrest assembly.
Figure 15:
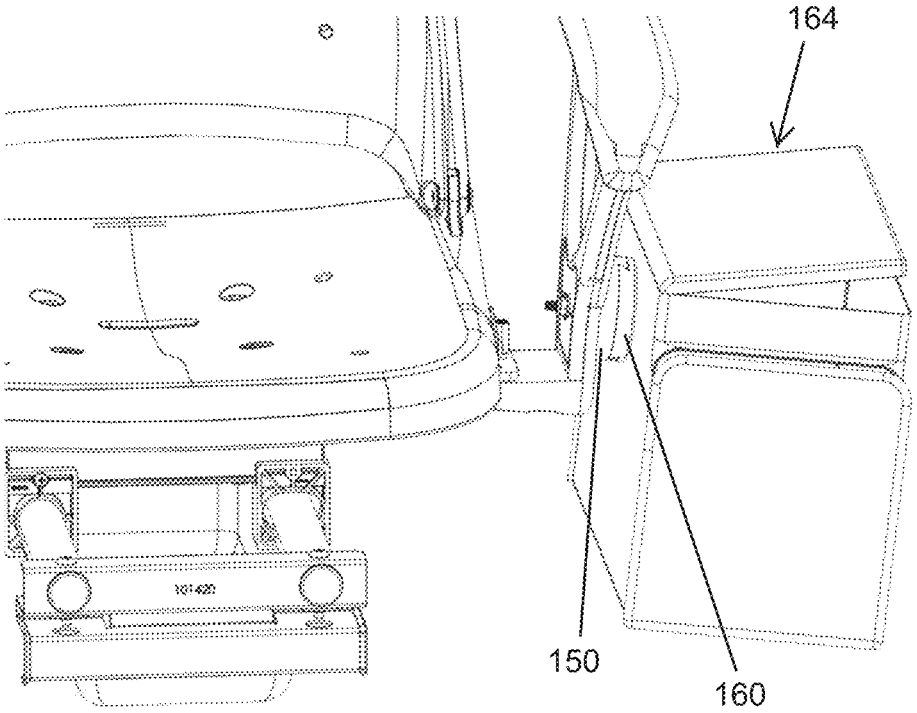
FIG. 15 is a front upper perspective view showing the example armrest assembly shown in FIG. 13, with a connector of a bag accessory removably connected to the mounting base on the armrest assembly.
Figure 16:
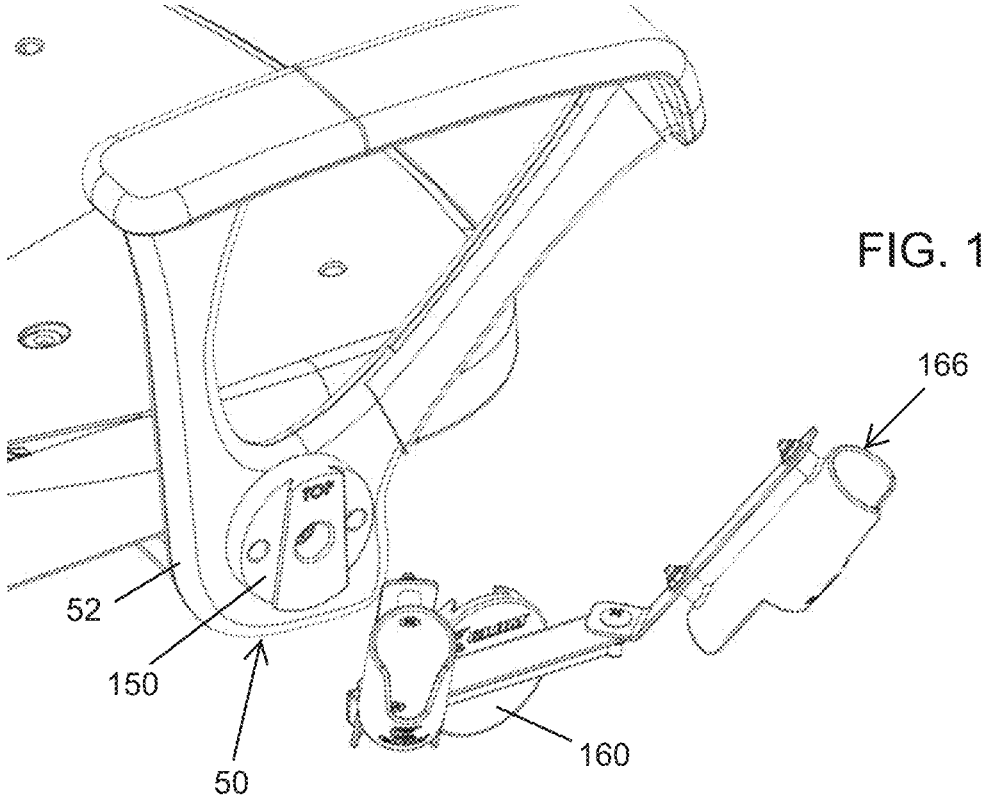
FIG. 16 is a rear upper perspective view showing the example armrest assembly shown in FIG. 13, with a rod holder accessory positioned for removable connection to the mounting base on the armrest assembly.
Figure 17:
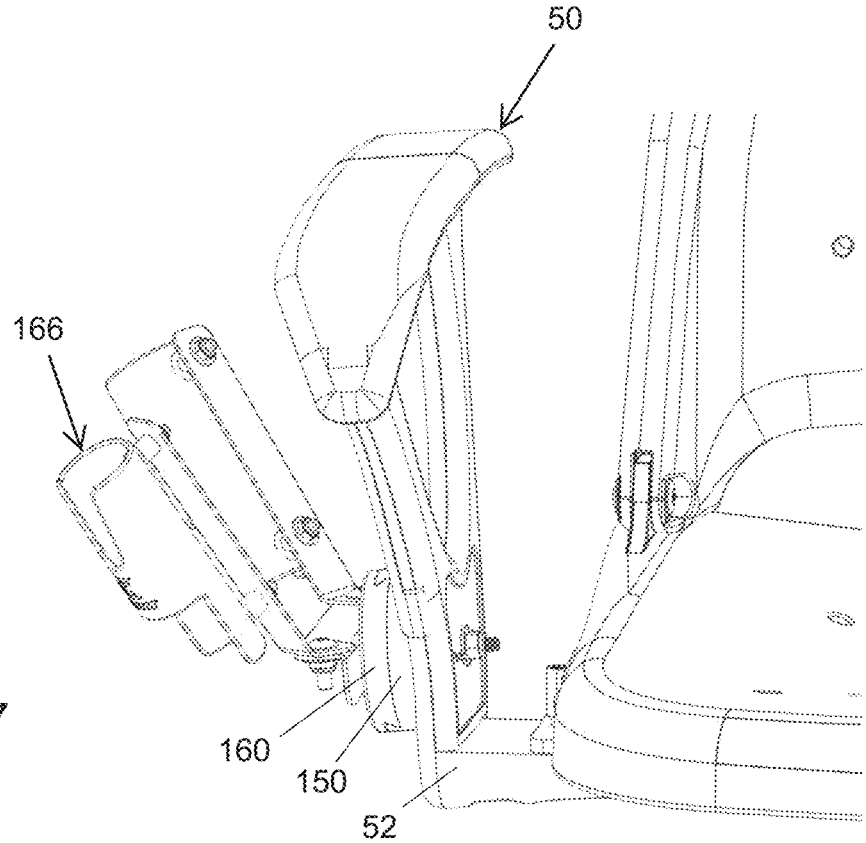
FIG. 17 is a front upper perspective view showing the example armrest assembly shown in FIG. 16, with a connector of a rod holder accessory removably connected to the mounting base on the armrest assembly.

The accessory mounting capability is highlighted in FIGS. 12-17. FIG. 13 show a cupholder accessory 162 secured to a mounting connector 160 that is positioned for removable connection to the mounting base 150 on the first armrest bracket 42 of the first armrest assembly 40. FIG. 14 shows the cupholder accessory 162 having a mounting connector 160 connected to the mounting base 150. FIG. 15 shows a bag accessory 164 having a mounting connector 160 connected to the mounting base 150. FIG. 16 show a rod holder accessory 166 secured to a mounting connector 160 that is positioned for removable connection to the mounting base 150 on the second armrest bracket 52 of the second armrest assembly 50. FIG. 17 shows the rod holder accessory 166 having a mounting connector 160 connected to the mounting base 150. It will be appreciated that the modular armrest system provides an advantageous platform for mounting further alternative accessories that may enhance the convenience and utility of the seat to which the modular armrest system is connected.

From the above disclosure, it will be apparent that modular armrest systems constructed in accordance with this disclosure may include a number of structural aspects that provide numerous advantages. The example aspects of such devices shown herein may exhibit one or more of the above-referenced potential advantages, depending upon the specific design chosen.

It will be appreciated that a modular armrest system may be connected to seats having various constructions and would be particularly advantageous if incorporated into a portable shelter having seating, such as in a flip-over ice fishing shelter. Thus, modular armrest systems may be provided in various configurations, whether in a fixed configuration or being adjustable. Any variety of suitable materials of construction, configurations, shapes and sizes for the components and methods of connecting the components may be utilized to meet the particular needs and requirements of an end user. It is to be understood that the invention is not to be limited to the examples disclosed herein, but rather, is intended to cover various modifications and equivalent arrangements included within the spirit and scope of the appended claims. Thus, the description and drawings should be considered illustrative and not restrictive of the invention, which is limited only by the appended claims and their legal equivalents.

The invention claimed is:

1. A modular armrest system for mounting to a seat having a seat bottom with a lower surface and opposed first and second lateral sides, the modular armrest system comprising:

an elongated base plate that extends below the lower surface of the seat bottom and further comprising at least one aperture that receives at least one fastener adapted to connect the elongated base plate to the seat bottom;

the elongated base plate further comprising opposed first and second ends that extend to locations beyond the respective opposed first and second lateral sides of the seat bottom;

a first armrest assembly and a second armrest assembly;

the first armrest assembly comprising a first mounting bracket having a horizontal portion and an upward extending portion, and the second armrest assembly comprising a second mounting bracket having a horizontal portion and an upward extending portion;

the horizontal portion of the first mounting bracket being connected to the first end of the elongated base plate and the horizontal portion of the second mounting bracket being connected to the second end of the elongated base plate;

a first generally horizontal arm support connected to the upward extending portion of the first mounting bracket and a second generally horizontal arm support connected to the upward extending portion of the second mounting bracket; and further comprising a first mounting plate adjacent and directly connected to the first lateral side of the seat bottom and being connected to the first end of the elongated base plate in a location laterally outward from the first lateral side of the seat bottom, and a second mounting plate adjacent and directly connected to the second lateral side of the seat bottom and being connected to the second end of the elongated base plate in a location laterally outward of the second lateral side of the seat bottom.

2. The modular armrest system of claim 1, wherein the first mounting plate further comprises a vertical aperture that receives a fastener connected to an aperture proximate the first end of the elongated base plate and the second mounting plate further comprises a vertical aperture that receives a fastener connected to an aperture proximate the second end of the elongated base plate.

3. The modular armrest system of claim 1, wherein the first mounting plate further comprises at least one horizontal aperture that receives a fastener adapted to directly connect the first mounting plate to the first lateral side of the seat bottom and the second mounting plate further comprises at least one horizontal aperture that receives a fastener adapted to directly connect the second mounting plate to the second lateral side of the seat bottom.

4. The modular armrest system of claim 1, wherein the first and second armrest assemblies are laterally adjustable relative to the elongated base plate.

5. The modular armrest system of claim 1, wherein the first and second armrest assemblies are vertically adjustable relative to the elongated base plate.

6. The modular armrest system of claim 5, wherein the first generally horizontal arm support is vertically adjustable relative to the first mounting bracket and the second generally horizontal arm support is vertically adjustable relative to the second mounting bracket.

7. The modular armrest system of claim 6, wherein the first generally horizontal arm support is vertically slidable relative to the upward extending portion of the first mounting bracket and the second generally horizontal arm support is vertically slidable relative to the upward extending portion of the second mounting bracket.

8. The modular armrest system of claim 1, wherein the at least one aperture in the elongated base plate that receives at least one fastener adapted to connect the elongated base plate to the seat bottom further comprises a plurality of generally centrally located apertures adapted to receive a respective plurality of fasteners adapted to connect the elongated base plate to the seat bottom.

9. The modular armrest system of claim 1, wherein the horizontal portion of the first mounting bracket and horizontal portion of the second mounting bracket are laterally adjustable relative to the respective first and second ends of the elongated base plate.

10. The modular armrest system of claim 9, wherein the horizontal portion of the first mounting bracket further comprises at least one aperture that receives at least one fastener connected to at least one aperture proximate the first end of the elongated base plate and the horizontal portion of the second mounting bracket further comprises at least one aperture that receives at least one fastener connected to at least one aperture proximate the second end of the elongated base plate.

11. The modular armrest system of claim 10, wherein the at least one aperture proximate the first end of the elongated base plate is a threaded aperture and the at least one aperture proximate the second end of the elongated base plate is a threaded aperture; and wherein the at least one aperture in the horizontal portion of the first mounting bracket is an elongated slot and the at least one aperture in the horizontal portion of the second mounting bracket is an elongated slot, with the respective elongated slots permitting lateral adjustment of the respective first and second armrest assemblies relative to the seat bottom.

12. The modular armrest system of claim 10, wherein the at least one aperture in the horizontal portion of the first mounting bracket includes a plurality of parallel elongated slots, the at least one aperture in the horizontal portion of the second mounting bracket includes a plurality of parallel elongated slots, the at least one aperture proximate the first end of the elongated base plate includes a plurality of parallel rows of a plurality of threaded apertures and the at least one aperture proximate the second end of the elongated base plate includes a plurality of parallel rows of a plurality of threaded apertures; and each row of a plurality of threaded apertures in the first or second end of the elongated base plate receives a fastener that extends through a respective slot in the respective horizontal portion of the first or second mounting bracket thereby providing a plurality of ranges of lateral adjustment of the armrest assemblies.

13. The modular armrest system of claim 1 in combination with a seat comprising:

the seat having a seat bottom with a lower surface, opposed first and second lateral sides and mounting holes in the lower surface of the seat bottom that receive fasteners that connect a seat base to the seat bottom, and a seat back pivotally connected to the seat bottom, and wherein the seat back is configured to extend upward from a rear of the seat bottom when in a position for use and pivots to a folded position generally above and parallel to the seat bottom and located between the first and second armrest assemblies.

14. The modular armrest system in combination with a seat of claim 13, wherein the seat base further comprises a swivel assembly.

15. The modular armrest system in combination with a seat of claim 13, wherein the seat base further comprises slides that are adjustable along parallel rails for seat fore and aft adjustment.

16. The modular armrest system of claim 1, further comprising an accessory mounting base connected to at least one of the first and second armrest assemblies and a cupholder, bag or rod holder accessory having a mounting connector removably connected to the accessory mounting base and positioning the accessory below a top surface of the generally horizontal arm support of the respective first or second armrest assembly to which the accessory mounting base is connected.

17. The modular armrest system of claim 16, wherein the mounting connector is configured for complementary slidable engagement with the accessory mounting base.

18. The modular armrest system of claim 14, further comprising spacers adapted to be located between the lower surface of the seat bottom and an upper surface of the swivel assembly to account for a thickness of the elongated base plate therebetween.

* * * * *